US005224876A

United States Patent [19]

Ito et al.

[11] Patent Number: 5,224,876

[45] Date of Patent: Jul. 6, 1993

[54] ELECTRICAL CONNECTOR

[75] Inventors: Masayuki Ito; Takahiro Yoneda, both of Kanagawa; Takayoshi Endo; Tamio Watanabe, both of Shizuoka, all of Japan

[73] Assignee: Yazaki Corporation, Tokyo, Japan

[21] Appl. No.: 849,690

[22] Filed: Mar. 12, 1992

[30] Foreign Application Priority Data

Mar. 14, 1991 [JP] Japan ..... 3-14846

[51] Int. Cl.[5] ..... H01R 13/40

[52] U.S. Cl. ..... 439/595; 439/596; 439/752; 439/877

[58] Field of Search ..... 439/595-598, 439/282, 603, 744, 752, 866, 867, 871, 872, 877, 879

[56] References Cited

U.S. PATENT DOCUMENTS

| | | | |
|---|---|---|---|
| 4,758,183 | 7/1988 | Aoyama | 439/596 |
| 4,840,578 | 6/1989 | Sato | 439/877 |
| 4,867,705 | 9/1989 | Yuasa | 439/596 |
| 5,067,913 | 11/1991 | Sagawa | 439/595 |

*Primary Examiner*—Paula A. Bradley

*Attorney, Agent, or Firm*—Armstrong, Westerman, Hattori, McLeland & Naughton

[57] ABSTRACT

The object of the present invention is to provide an electrical connector in which terminals with wires having a diameter larger than another wire can be accommodated in the cavities of the connector without changing the size of the connector and without using a butt joint. The electrical connector according to the present invention includes a connector housing, a first terminal for connecting a first wire, the first terminal having an electrical contact portion at one end thereof, a conductor clamping portion at another end thereof, and intermediate portion, a second terminal for connecting a second wire having a diameter larger than that of the first wire, the second terminal having an electrical contact portion at one end thereof, a conductor clamping portion at another end thereof, and intermediate portion, the intermediate portion of the second terminal being formed to be longer than that of the first terminal, and a plurality of terminal accommodating cavities disposed in the connector housing for accommodating the first and second terminals, wherein each of the second terminals is accommodated so as to protrude form a rear end of the plurality of terminal accommodating cavities and at least one first terminal is disposed between the second terminals.

5 Claims, 4 Drawing Sheets

ELECTRICAL CONNECTOR

BACKGROUND OF THE INVENTION

1. Field of the Invention

The present invention relates to an electrical connector, and more particularly to, a small size connector in which a large-diameter wire is directly clamped by a small size terminal while maintaining the size of the connector without using a butt joint for a small-diameter wire and the large-diameter wire.

2. Description of the Prior Art

In general, a prescribed size of wire is applied to terminals of an electrical connector and a plurality of terminal accommodating cavities corresponding to the size of the terminals are provided in a connector housing. The terminals having a prescribed size and the wires to which the terminals are applied are hereinafter referred to as first terminals and first wires, respectively.

When a small-size connector is provided with terminal accommodating cavities at intervals of 2.5 mm or 3.0 mm, the cross section of the first wire used for the terminal is small, usually 0.3 mm or 0.5 mm, so that when a large-diameter wire is needed to reduce electrical resistance in an electrical circuit or to maintain safety, a butt joint has been used as shown in FIG. 6. That is, a first wire b is first clamped with a conductor clamping portion a1 and a insulator clamping portion a2 of a first terminal and then the first wire is connected to a large-diameter (2 mm) wire b' with a butt joint c. This results from the fact that the first terminal a with the clamped large-diameter wire can not be accommodated in the cavities due to the relation in size between the terminal accommodating cavities and the first terminal a.

In the above conventional method for connecting a large-diameter wire with the butt joint c, not only additional work for assembling the joint inevitable, but also an additional joint portion is regarded as an unstable portion. resulting in decreased reliability of the electrical circuit.

SUMMARY OF THE INVENTION

The present invention has been accomplished to eliminate above drawbacks of the conventional connecting method. It is an object of the present invention to provide an electrical connector in which terminals with wires having a diameter larger than other wires used in the connectors the first wire can be accommodated in the cavities of the connector without changing the size of the connector and without using a butt joint.

An electrical connector according to the present invention comprises: a connector housing; a first terminal for connecting a first wire, the first terminal comprising an electrical contact portion at one end thereof, a conductor clamping portion at another end thereof, and intermediate portion; a second terminal for connecting a second wire having a diameter larger than that of the first wire, the second terminal comprising an electrical contact portion at one end thereof, a conductor clamping portion at another end thereof, and intermediate portion, the intermediate portion of the second terminal being formed to be longer than that of the first terminal; and a plurality of terminal accommodating cavities disposed in the connector housing for accommodating the first and second terminals, wherein each of the second terminals is accommodated so as to protrude from a rear end of the plurality of terminal accommodating cavities and at least one first terminal is disposed between the second terminals.

BRIEF DESCRIPTION OF THE DRAWINGS

The present invention will be more apparent from the ensuring description with reference to the accompanying drawings wherein.

DETAILED DESCRIPTION OF PREFERRED EMBODIMENTS

Figure 1:
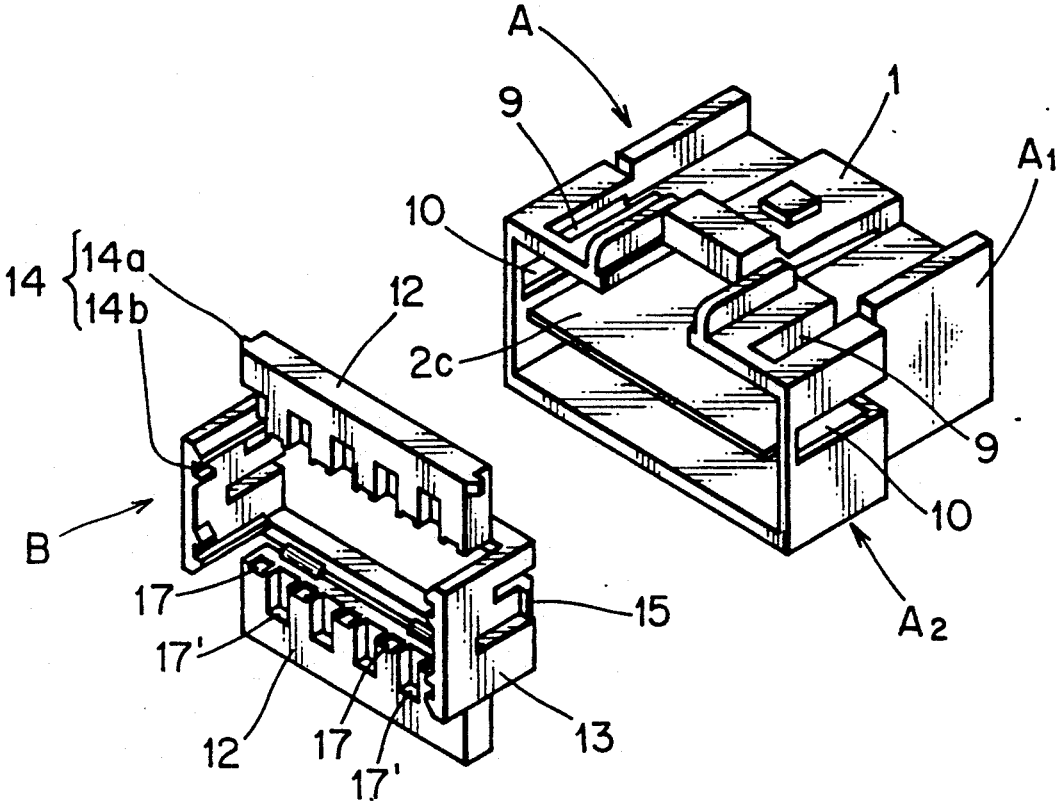
FIG. 1 is a perspective view of a male connector housing and a rear holder of an electrical connector according to the present invention.
Figure 2:
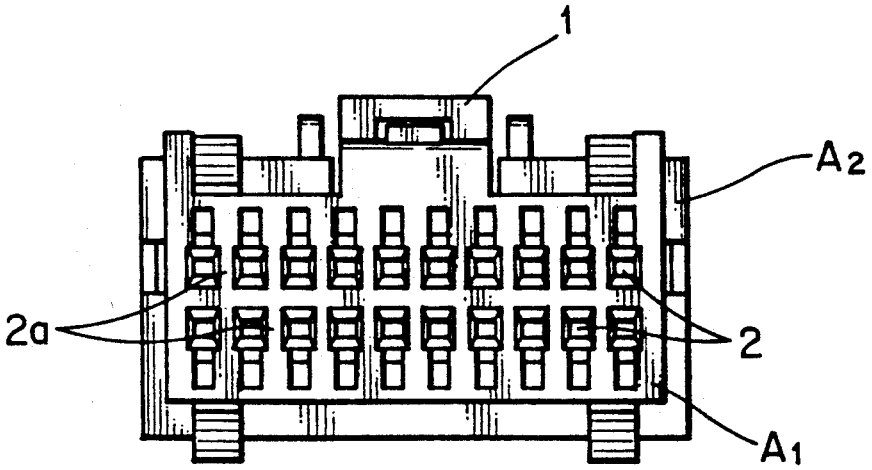
FIG. 2 is a front view of the male connector housing of FIG. 1.

In FIGS. 1 and 2, a male connector housing A is made of synthetic resin and a rear holder B for double locking is connected to the male connector housing on its electrical conductor portion side. The male connector housing A comprises a main body A1 and a rear holder accommodating portion A2. On the periphery of the main body A1 is provided a resilient locking arm 1 for engagement with a female connector housing not shown. Further, in the main body is formed a plurality of terminal accommodating cavities 2 at regular intervals in two stories with a partition between.

Figure 3A:
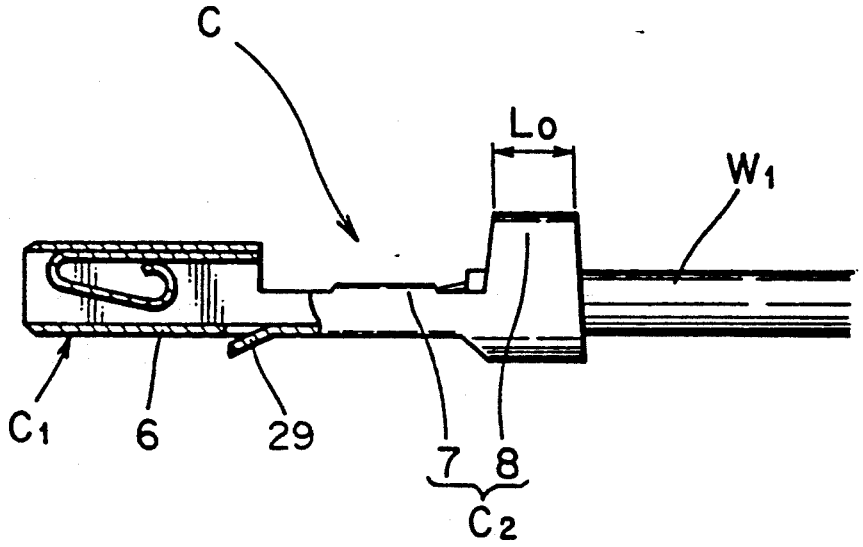
FIGS. 3A and 3B are partially cutaway side views of a first terminal C and second terminal C' composing the connector of the present invention, respectively.

The terminal accommodating cavities 2 are each formed to have a size in accordance with the size of a first terminal C of FIG. 3A. As shown in FIG. 4, cavities 2 are each is provided with a stopping wall for the first terminal C at a front opening thereof, a resilient locking arm 4 and a guide channel 5 on inside walls thereof.

The first terminal C has a known structure and includes an electrical contact portion C1 for a mating terminal at a free end of a base plate 6 and a wire connecting portion C2 comprising a conductor clamping portion 7 and an insulator clamping portion 8 at the other end of the base plate 6. The wire connecting portion C2 is clamped on the first wire W1 having a small-diameter. The electrical contact portion C1 has the shape of cylindrical female terminal to receive a tab of the mating terminal not shown. Further, base plate 6 is formed with a struck-out projection 29 to prevent misinsertion of the terminal.

Figure 3B:
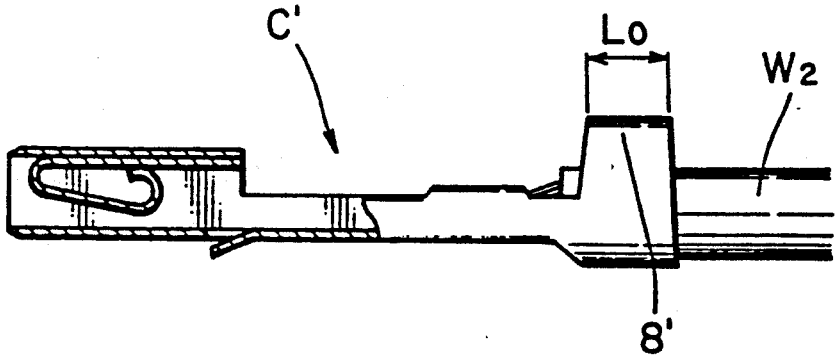
Figure 4A:
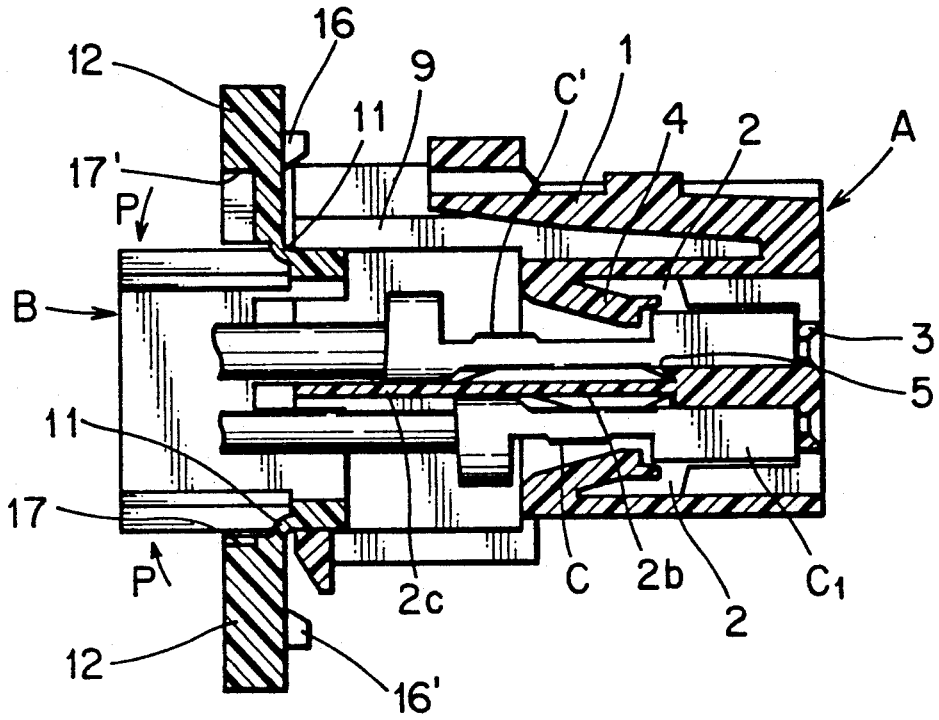
FIGS. 4A and 4B are laterally cross-sectional views showing temporary and final locking states of the rear holder of the connector according to the present invention.

A second terminal C' is illustrated in FIG. 3B. The second terminal C' has an intermediate portion of base plate 6 longer than that of the first terminal C by the length L0 of the insulator clamping portion 8, so that the insulator clamping portion 8' protrudes from rear end of the terminal accommodating cavities 2 to be placed on a wire mounting wall 2c as illustrated in FIG. 4A. The protruding insulator clamping portion 8' is clamped with a wire W2 having a diameter larger than the first wire W1.

Referring to FIG. 1, the rear holder accommodating portion A2 of the male connector housing A is formed to have the shape of rectangular frame. On upper and lower walls thereof are provided final locking holes 9 and on right and left walls temporary locking holes 10. Further, the rear holder accommodating portion A2 is provided with the wire mounting wall 2c extending from a partition 2b put between upper and lower terminal accommodating cavities 2. The rear holder B is also a rectangular frame which is inserted into the rear holder accommodating portion A2. The upper and lower walls of the rear holder B are provided with flaps 12, which are connected to the walls with hinges 11 and can be opened or closed. Between side walls 13 of the rear holder B and the flaps 12 is provided a locking means comprising a projection 14a and locking channel 14b. Further, on the front end of the outer side wall 13 are formed temporary locking projections 15 which are adapted to be locked with the temporary locking holes 10 and on the rear end of the outer wall of the flaps 12 is provided a final locking projection 16 which is adapted to be locked with the final locking hole 9.

The flaps of the rear holder B are used for preventing the first terminal C or the second terminal from slipping off. In this embodiment, the flaps 12 are provided with a locking portion 17 for the first terminal C and another locking portion 17' for the second terminal C', alternately as concave and convex portions in accordance with the terminal accommodating cavities 2.

As shown in FIG. 4A, with the above structure, the rear holder is inserted into the rear holder accommodating portion A2 of the male connector housing A with the flaps 12 on the upper and lower walls of the rear holder B being open. Then, the engagement of the temporary locking projection 15 and the temporary hole 10 temporarily locks the rear holder B with male connector housing A. Under the temporary locking condition, the first terminal C and the second C' are inserted into the terminal accommodating cavities 2. When the insertion is completed. front portions of the respective terminals abut the stopping wall 3 and the resilient arm 4 engages the rear shoulder of the terminals C', which prevent the respective terminals C and C' from slipping off in order to achieve a temporary locking state. At the insertion of the terminals C and C', the engagement of the struck-out projection 29 and the guide channel 5 prevents the terminals each from being inserted upside down.

After the temporary locking state described above, the upper and lower flaps are closed in the direction as shown in an arrow P in FIG. 4A and are locked with the locking means 14 in FIG. 1. Then, the rear holder B is further inserted into the rear holder accommodating portion A2 to be doubly locked.

Figure 4B:
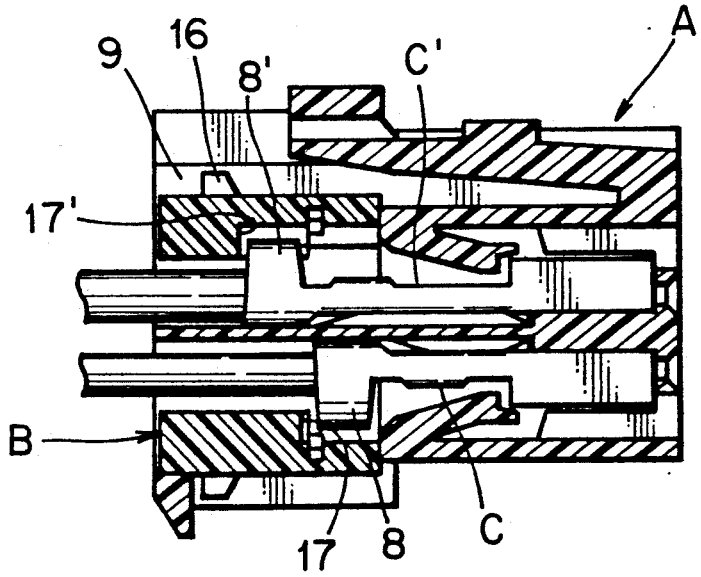

FIG. 4B shows the final locking state of the terminals. In the figure, not only the insulator clamping portion 8 of the first terminal C and the locking portion 17 are engaged with each other but also the insulator clamping portion 8' of the second terminal C' and the locking portion 17' are engaged with each other for double locking to prevent slipping off of the terminals. At the same time, the rear holder B is finally locked by the engagement of the final locking projection 16 and the final locking hole 9. Upon the final lock of the rear holder B, when some terminals of the terminals C and C' are incompletely inserted, the attempted insertion of the rear holder B will automatically prevent the incomplete insertion. As a result, as shown in the figure, the insulator clamping portion 8' of the second terminal C' is mounted on the wire mounting wall 2c in the rear holder accommodating portion A2 to be protected from outer condition.

Figure 5:
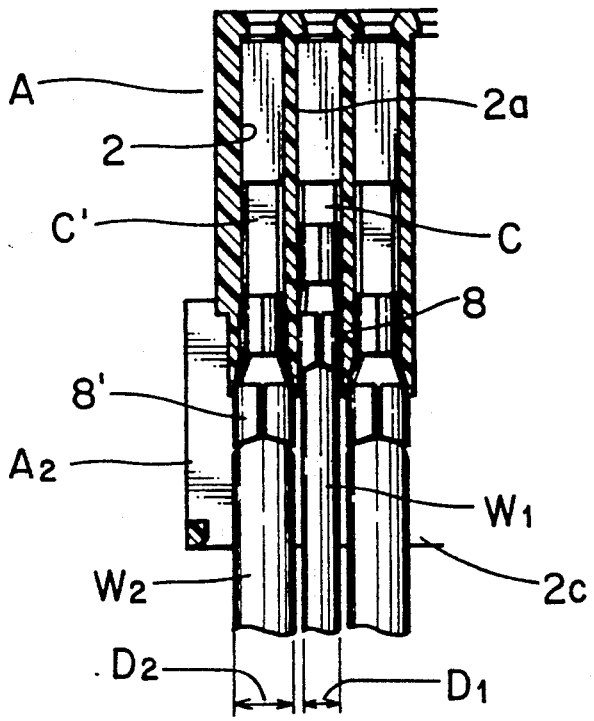
FIG. 5 is a primary cross-sectional view showing a condition in which the first and second terminals are accommodated in terminal accommodating cavities of the connector according to the present invention.
Figure 6:
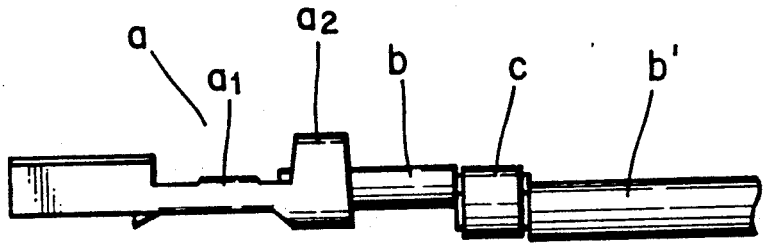
FIG. 6 PRIOR ART
FIG. 6 is a drawing illustrating a method for connecting a small-diameter and large-diameter wires of a conventional connector.

FIG. 5 shows a state in which the first terminal C and the second terminal C' are accommodated in the terminal accommodating cavities. The terminals C and C' are disposed alternately and the insulator clamping portion 8' of the terminal C' protrudes from the rear end of the terminal accommodating cavities 2 each and is positioned in the rear holder accommodating portion A2 while the large-diameter wire W2 is clamped with the clamping portion 8'.

FIG. 5 clearly shows that the first terminal C can not be accommodated under the condition that the large-diameter wire W2 is clamped with the insulator clamping portion 8 of the first terminal C. When the first terminal C and the second terminal C' are alternately inserted in the cavities 2, the thickness of the wall will absorb the difference of the diameter D1 of the small-diameter wire W1 and the diameter D2 of the large-diameter wire W2 behind the partition 2a between the cavities. As a result, both terminals are accommodated in the cavities 2 as they are without changing the size of the cavities. There is no fear that the insulator clamping portion 8' of the second terminal C' touches the neighboring insulator clamping portion 8 of the first terminal C, which maintains a stable insulating state.

Although, in the above embodiment, the first terminal C and the second terminals C' are alternately accommodated in the terminal accommodating cavities 2, at least one first terminal may be disposed between said second terminals.

As described above, in the electrical connector according to the present invention, the first terminals adapted to a prescribed size of the wire and exclusive connector housing are used as they are and the second terminals are used at the same time by partially modifying the second terminals. As a result, a wire having a diameter larger than that of the wire connected with the first terminal can be clamped and connected without a conventional butt joint, resulting in increased reliability of the circuit and decreased production cost.

What is claimed is:

1. An electrical connector comprising:

a connector housing;

a first terminal for connecting a first wire, said first terminal comprising an electrical contact portion at one end thereof, a conductor clamping portion at another end thereof, and an intermediate portion;

a second terminal for connecting a second wire having a diameter larger than that of the first wire, said second terminal comprising an electrical contact portion at one end thereof, a conductor clamping portion at another end thereof, and an intermediate portion, said intermediate portion of said second terminal being formed to be longer than that of said first terminal; and a plurality of terminal accommodating cavities disposed in said connector housing for accommodating said first and second terminals, wherein each of said second terminals is disposed in a terminal accommodating cavity so as to protrude from a rear end of said terminal accommodating cavity and wherein no two individual second terminals are disposed in terminal accommodating cavities adjacent to one another.

2. An electrical connector as claimed in claim 1, wherein said terminal accommodating cavities for accommodating said first and second terminals are substantially the same size.

3. An electrical connector as claimed in claim 1, wherein a resilient locking arm is provided on an inner wall of the plurality of terminal accommodating cavities each such that said resilient locking arm projects forwardly from said inner wall opposing the insulator clamping portion of the first and second terminals each, and when the first and second terminals reach a locked position the electrical contact portion of the first and second terminals each is engaged with the resilient locking arm of the terminal accommodating cavity.

4. An electrical connector as claimed in claim 3, wherein a rear holder accommodating portion having a shape of a substantially rectangular frame is integrally formed with the connector housing, and a rear holder to be accommodated said rear holder accommodating portion comprises:

a substantially rectangular frame;

flaps hinged on upper and lower walls of said rear holder; and locking portions formed on said flaps, wherein after said rear holder is inserted into the connector housing, the first and second terminals pass through the rear holder so as to be accommodated in the terminal accommodating cavities, and further insertion of the rear holder permits the insulator clamping portion of the first and second terminals to be engaged with the locking portions of the rear holder.

5. An electrical connector as claimed in claim 4, wherein said rear holder is provided with temporary locking holes on side walls thereof and final locking holes on upper and lower walls, and said rear holder is provided with resilient temporary locking projections engageable with said temporary locking holes at side walls thereof and resilient final locking projections engageable with said final locking holes at upper and lower walls.

* * * * *